US006276777B1

(12) United States Patent
Schiaffino et al.

(10) Patent No.: US 6,276,777 B1
(45) Date of Patent: Aug. 21, 2001

(54) VARIABLE MAXIMUM OPERATING TEMPERATURE FOR A PRINTHEAD

(75) Inventors: Stefano Schiaffino, Milan (IT); Sebastia Castelltort, Igualada; David H. Donovan, Barcelona, both of (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/120,682

(22) Filed: Jul. 21, 1998

(51) Int. Cl.[7] ..... B41J 29/38; B41J 29/393; B41J 2/165; B41J 2/14

(52) U.S. Cl. ..... 347/17; 347/19; 347/23; 347/49

(58) Field of Search ..... 347/17, 19, 23, 347/49, 35, 14, 85, 86, 60, 40; 358/298; 400/121, 126

(56) References Cited

U.S. PATENT DOCUMENTS

| | | | | |
|---|---|---|---|---|
| 4,791,435 | | 12/1988 | Smith et al. | 346/140 |
| 4,860,034 | * | 8/1989 | Watanabe et al. | 347/17 |
| 4,910,528 | | 3/1990 | Firl et al. | 346/1.1 |
| 5,075,690 | | 12/1991 | Kneezel | 346/1.1 |
| 5,107,276 | | 4/1992 | Kneezel et al. | 346/1.1 |
| 5,235,346 | | 8/1993 | Yeung | 346/76 PH |
| 5,363,134 | * | 11/1994 | Barbehenn et al. | 347/49 |
| 5,576,745 | * | 11/1996 | Matsubara | 347/17 |
| 5,648,806 | | 7/1997 | Steinfield et al. | 347/87 |
| 5,675,367 | | 10/1997 | Scheffelin et al. | 347/86 |
| 5,736,995 | | 4/1998 | Bohorquez et al. | 347/14 |

FOREIGN PATENT DOCUMENTS

| | | | | |
|---|---|---|---|---|
| 403 140 248 | * | 6/1991 | (JP) | 347/17 |

* cited by examiner

*Primary Examiner*—John Barlow
*Assistant Examiner*—Charles W. Stewart, Jr.
(74) *Attorney, Agent, or Firm*—Skjerven Morrill Macpherson LLP; Philip W. Woo; David C. Hsia

(57) ABSTRACT

A variable maximum operating temperature for a printhead is defined and utilized within both a system and a method. The variable maximum operating temperature varies according to one or more operating conditions within a printer into which the printhead may be installed. If a detected temperature of the printhead is greater than the variable maximum operating temperature for a detected operating condition, the printer will be shut down to prevent overheating. Accordingly, the system and method extend the useful life of the printhead and reduce paper waste.

11 Claims, 8 Drawing Sheets

VARIABLE MAXIMUM OPERATING TEMPERATURE FOR A PRINTHEAD

CROSS REFERENCE TO RELATED APPLICATIONS

This Application relates to the subject matter disclosed in the following United States Patents and co-pending United States Applications:

U.S. Pat. No. 4,791,435 to Smith, et al., entitled "Thermal Inkjet Printhead Temperature Control;"

U.S. Pat. No. 4,910,528 to Smith, et al., entitled "Ink Jet Printer Thermal Control System;"

U.S. Pat. No. 5,235,346 to Yeung, entitled "Method and Apparatus For Controlling the Temperature of Thermal Ink Jet and Thermal Printheads That Have a Heating Matrix System;"

U.S. Pat. No. 5,648,806 to Steinfield, et al., entitled "Stable Substrate Structure For A Wide Swath Nozzle Array In A High Resolution Ink Jet Printer;"

U.S. application Ser. No. 08/706,051, filed Aug. 30, 1996, entitled "Printer Using Print Cartridge With Internal Pressure Regulator;"

U.S. Pat. No. 5,675,367 to Scheffelin, et al., entitled "Ink Jet Print Cartridge Having Handle Which Incorporates An Ink Fill Port;"

U.S. Pat. No. 5,736,995 to Bohorquez, et al., entitled "Temperature Control of Thermal Inkjet Printheads By Using Synchronous Non-Nucleating Pulses;" and United States Application filed herewith, entitled "Selectively Warming A Printhead," by Schiaffino, et al.

The above patents and co-pending applications are assigned to the present Assignee and are incorporated herein by reference.

TECHNICAL FIELD OF THE INVENTION

The present invention generally relates to ink jet and other types of printers and, in particular, to a variable maximum operating temperature for a printhead.

BACKGROUND OF THE INVENTION

Many modern printing devices incorporate thermal ink jet technology. Typically, this technology utilizes a printhead (also known as a pen) having a silicon die supporting one or more vaporization chambers. During operation, resistors or other ink ejection elements on the silicon die are heated in order to vaporize and eject ink through nozzles overlying the vaporization chambers, thereby causing dots of ink to be printed on a recording medium, such as paper.

In general, the temperature of a printhead will change or fluctuate while printing. When a printer is printing "light" areas or in a slow mode, the printhead temperature will drop; when a printer is printing "dense" areas or in a fast mode, the printhead temperature will rise. As the printhead temperature changes, it is important to ensure that the silicon die does not overheat. Overheating results primarily when the printhead has run out of ink (OOI) or because the printhead is experiencing a global de-prime (i.e., a disruption of the continuous flow of ink into a vaporization chamber due to a large air bubble caused by out-gassing or air-gulping). In such cases, the problem of overheating must be detected quickly and efficiently in order to avoid permanent damage to the printhead. Furthermore, if the printhead has run out of ink or is experiencing a global de-prime, printing must be interrupted to avoid the waste of paper.

Previous techniques set a fixed maximum operating temperature for the printhead; when the temperature of the printhead exceeded this fixed maximum operating temperature, a thermal shutdown was initiated for the printer. To avoid improper thermal shutdown when the printhead was simply getting warmer (for example, because the printer was printing a high density area or a in fast print mode), the fixed maximum operating temperature was required to be set conservatively high. Although such previous techniques were easy to implement, their effectiveness was limited only to cases where out-of-ink or global de-prime conditions occurred while printing dense areas of ink in fast mode. In fact, if either of the two failure conditions occurred while printing a low density area or while printing a high density area under a slow print mode, the printhead temperature would not increase sufficiently to trigger thermal shutdown. Accordingly, previous techniques did not adequately address the problems associated with overheating in a printhead.

SUMMARY OF THE INVENTION

The disadvantages and problems associated with shutting down a printer to prevent overheating of a printhead have been substantially reduced or eliminated using the present invention.

In accordance with one embodiment of the present invention, a system includes an operating condition sensor for detecting an operating condition within a printer and a printhead temperature sensor for detecting a temperature of a printhead. A controller is coupled to the operating condition sensor and the printhead temperature sensor. The controller compares the detected temperature of the printhead against a variable maximum operating temperature which varies according to the detected operating condition.

In accordance with another embodiment of the present invention, a method is provided which comprises the following steps: creating a thermal model which relates an operating condition of a printer to a temperature for a printhead incorporated into the printer, and establishing a variable maximum operating temperature for the printhead based upon the thermal model, the variable maximum operating temperature varying according to the operating condition.

In accordance with yet another embodiment of the present invention, a printer comprises a print cartridge having a printhead and a system for varying the maximum operating temperature of the printhead.

Important technical advantages of the present invention include varying the maximum operating temperature for a printhead depending upon the actual operating conditions or characteristics of a printer, wherein a printer condition is something which can be detected and a printer characteristic is something which can be calculated or predicted from one or more printer conditions. Specifically, the maximum operating temperature may be characterized as a function of any one, or a combination, of various printer conditions or characteristics, such as duty cycle, print density, print speed, and the like, which can be empirically detected, calculated, or predicted. Thus, different maximum operating temperatures will be applied to different operating conditions and/or characteristics. For any set of conditions/characteristics under which a printer may operate, if a detected temperature for the printhead exceeds the maximum operating temperature applicable to those conditions/characteristics, the printer will be shut down. In this way, the present invention reduces the likelihood that a printhead will overheat.

Accordingly, this technique extends the useful life of a printhead and reduces waste associated with paper that otherwise might be fed through the printer. Other important technical advantages are readily apparent to one skilled in the art from the following figures, descriptions, and claims.

BRIEF DESCRIPTION OF THE DRAWINGS

For a more complete understanding of the present invention and for further features and advantages, reference is now made to the following description taken in conjunction with the accompanying drawings, in which.

DETAILED DESCRIPTION OF THE PREFERRED EMBODIMENTS

The preferred embodiments of the present invention and their advantages are best understood by referring to FIGS. 1–9 of the drawings. Like numerals are used for like and corresponding parts of the various drawings.

Figure 1:
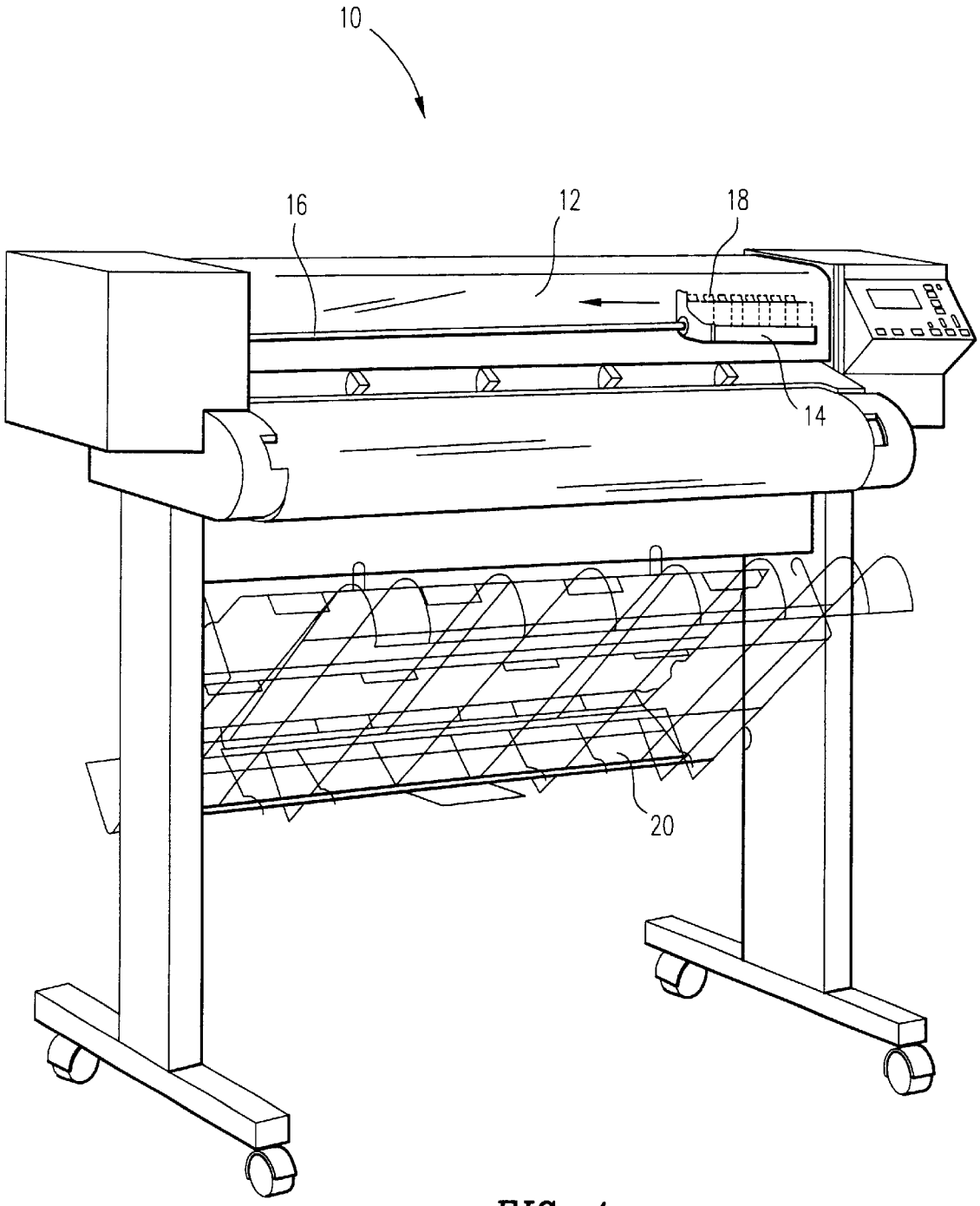
FIG. 1 illustrates an exemplary printer into which a system of the present invention can be incorporated.

Even though the invention can be used in any printing environment which incorporates thermal ink-jet technology, the presently preferred embodiment of the invention is used in a large format, ink jet printer 10 of the type illustrated in FIG. 1. Ink jet printer 10 includes print zone 12 within which a movable carriage 14 rides along a slide rod 16. A stepper motor (not shown), connected to carriage 14 using a conventional drive belt and pulley arrangement, is used for transporting carriage 14 across print zone 12. A scanning mechanism (not shown) may include a coded strip which is optically detected by a photodetector in carriage 14 for precisely positioning the carriage. One or more print cartridges 18 are held in carriage 14. Print cartridges 18 can hold inks of different colors, such as yellow, magenta, cyan, and black. In one embodiment, each print cartridge 18 prints at 600 dots per inch (dpi). More details of an exemplary print cartridge 18 are described below with reference to FIG. 2. A tray 20 may support a wide, continuous roll of paper.

In operation, paper from tray 20 is fed into ink jet printer 10. The paper is stopped in print zone 12 where carriage 14, containing print cartridges 18, is then scanned across the paper for printing a swath of ink thereon. After a single scan or multiple scans over one position within print zone 12, the paper is incrementally shifted using a conventional motor and feed rollers to a next position, and then carriage 14 again scans across the paper for printing a next swath of ink. When printing on the paper is complete, the paper is forwarded out of print zone 12, and held in a position that allows the ink to dry.

Figure 2:
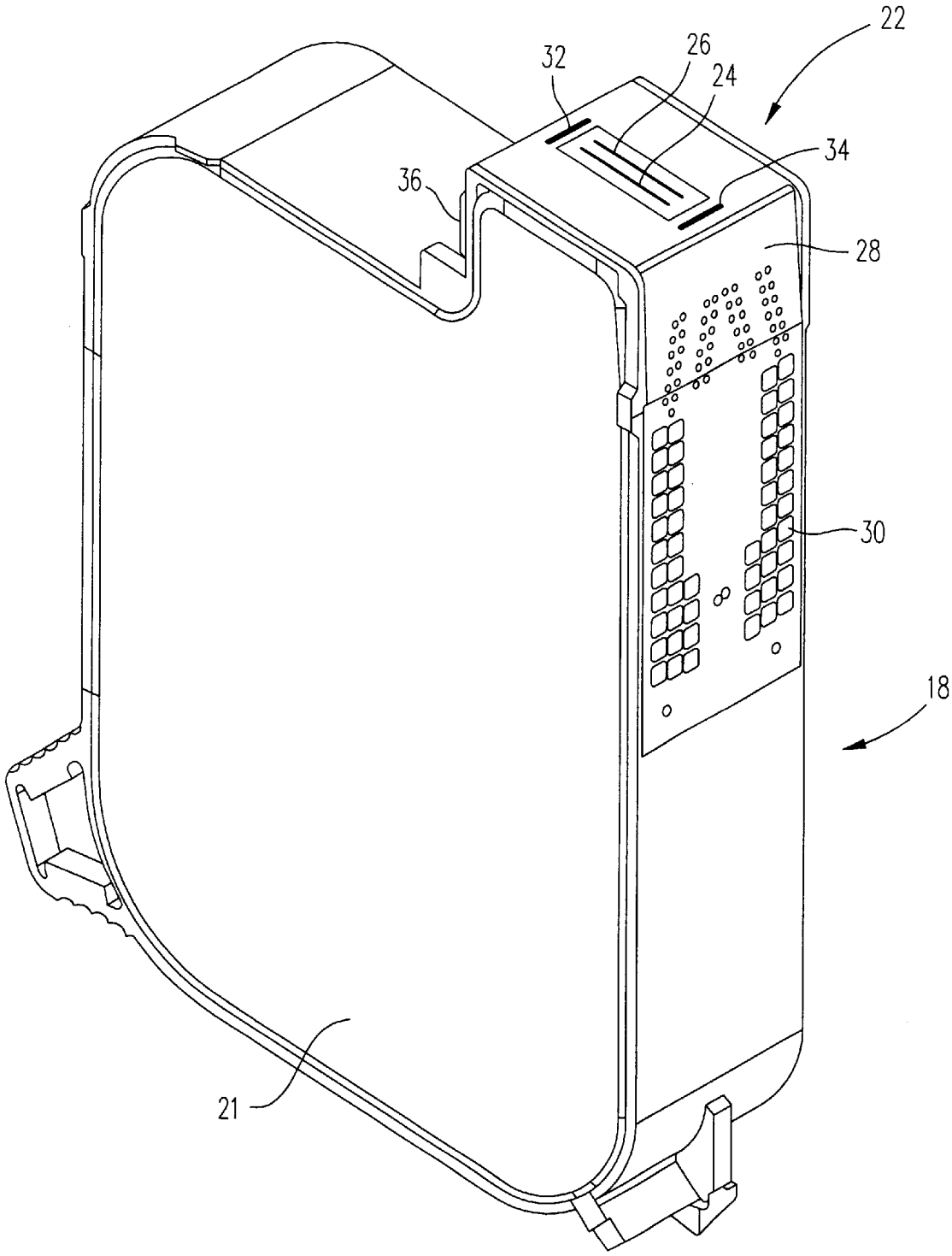
FIG. 2 illustrates an exemplary print cartridge including a printhead, the maximum operating temperature of which may be varied according to the present invention.

FIG. 2 illustrates an exemplary print cartridge 18 which may be incorporated into an ink jet printer, such as that shown in FIG. 1. Referring to FIG. 2, print cartridge 18 comprises an ink reservoir 21 and a printhead 22. Ink reservoir 21 stores a supply of ink, which may be refilled or replenished as necessary, such as by a flexible tube leading to a stationary ink supply. Printhead 22 functions to eject ink onto a print medium, such as paper. In accordance with the present invention, the maximum operating temperature for printhead 22 may be varied according to the actual operating conditions of a printer into which print cartridge 18 is incorporated.

Printhead 22 is situated in a "snout" of print cartridge 18 and may be formed using a process known as Tape Automated Bonding (TAB). Printhead 22 includes a nozzle member 24 comprising one or more columns of offset holes or orifices 26 formed in a flexible polymer circuit 28 by, for example, laser ablation. Although not expressly shown, behind each of orifices 26 lies a vaporization chamber which is heated by resistors within a silicon substrate or die of printhead 22.

One or more contact pads 30, designed to interconnect with electrodes on a printer, are formed on a front surface of flexible polymer circuit 28. Each of contact pads 30 terminates one end of various conductive traces (not shown) formed on a back surface of flexible polymer circuit 28 using a conventional photolithographic etching and/or plating process. Contact pads 30 and the conductive traces cooperate to provide externally generated energization signals to printhead 22.

Windows 32 and 34 extend through flexible circuit 28 and are used to facilitate bonding of the other ends of the conductive traces to electrodes on the silicon substrate containing heating resistors. Windows 32 and 34 are filled with an encapsulant to protect any underlying portion of the conductive traces and the substrate.

Flexible circuit 28 is bent over a back wall 36 of the print cartridge "snout" and extends approximately one half the length of back wall. This portion of flexible circuit 28 is needed for the routing of conductive traces which are connected to the substrate electrodes through the far end window 32. In particular, conductive traces, connected to contact pads 30, are routed over the bend and then connected to the substrate electrodes through windows 32 and 34 in flexible circuit 28.

Additional detail regarding print cartridge 18 is found in U.S. Pat. No. 5,648,806, entitled "Stable Substrate Structure for a Wide Swath Nozzle Array in a High Resolution Inkjet Printer," issued to Steven W. Steinfield, et al., assigned to the present assignee and incorporated herein by reference.

Generally speaking, the present invention provides an improved technique for initiating the shutdown of a printer when a printhead (of a print cartridge incorporated into such printer) begins to overheat. The present invention recognizes that the temperature at which a printhead begins to overheat is affected by, and hence, directly related to, various operating conditions and characteristics of a printer, wherein a printer condition is something which can be detected and a printer characteristic is something which can be calculated or predicted from one or more printer conditions. For example, if a printer is operating in a fast mode, the temperature at which a printhead begins to overheat will be higher than if the printer was operating in a slow mode. Similarly, if a printer is printing a dense area of ink, overheating of a printhead will begin at a higher temperature than if the printer was printing a light area.

Given this relationship between the operating conditions/characteristics of a printer and the temperature at which a printhead begins to overheat, the present invention varies the maximum operating temperature for a printhead according to the actual operating conditions and characteristics of the printer. Specifically, the maximum operating temperature may be characterized or defined as a function of any one, or a combination, of various conditions or characteristics, such as duty cycle, print density, print speed, and the like, which can be empirically detected, calculated, or predicted. For any set of conditions/characteristics under which a printer may operate, if an actual temperature for the printhead exceeds the maximum operating temperature applicable to those conditions/characteristics, the printer will be shut down to prevent overheating. This technique of the present invention increases the likelihood that a shut down will be initiated before the printhead has overheated. Accordingly, the present invention extends the useful life of printhead and reduces waste associated with paper that otherwise might be fed through the printer.

Although the present invention contemplates a number of printing conditions/characteristics, tests have shown that the thermal characterization for a printhead closely follows the duty cycle for a printer. The duty cycle is derived from the carriage velocity (i.e., the speed at which a print cartridge carriage moves along a slide rod), the print area density (i.e., how much ink is to be deposited onto a particular area of printing), and the number of passes or scans of the carriage. In particular, the duty cycle (dc) may be defined by the following equation:

$$dc = AD\frac{V_{carr}}{n_{pass}} \tag{1}$$

where AD is the print area density, $V_{carr}$ is the carriage velocity, and $n_{pass}$ is the number of passes.

Figure 3:
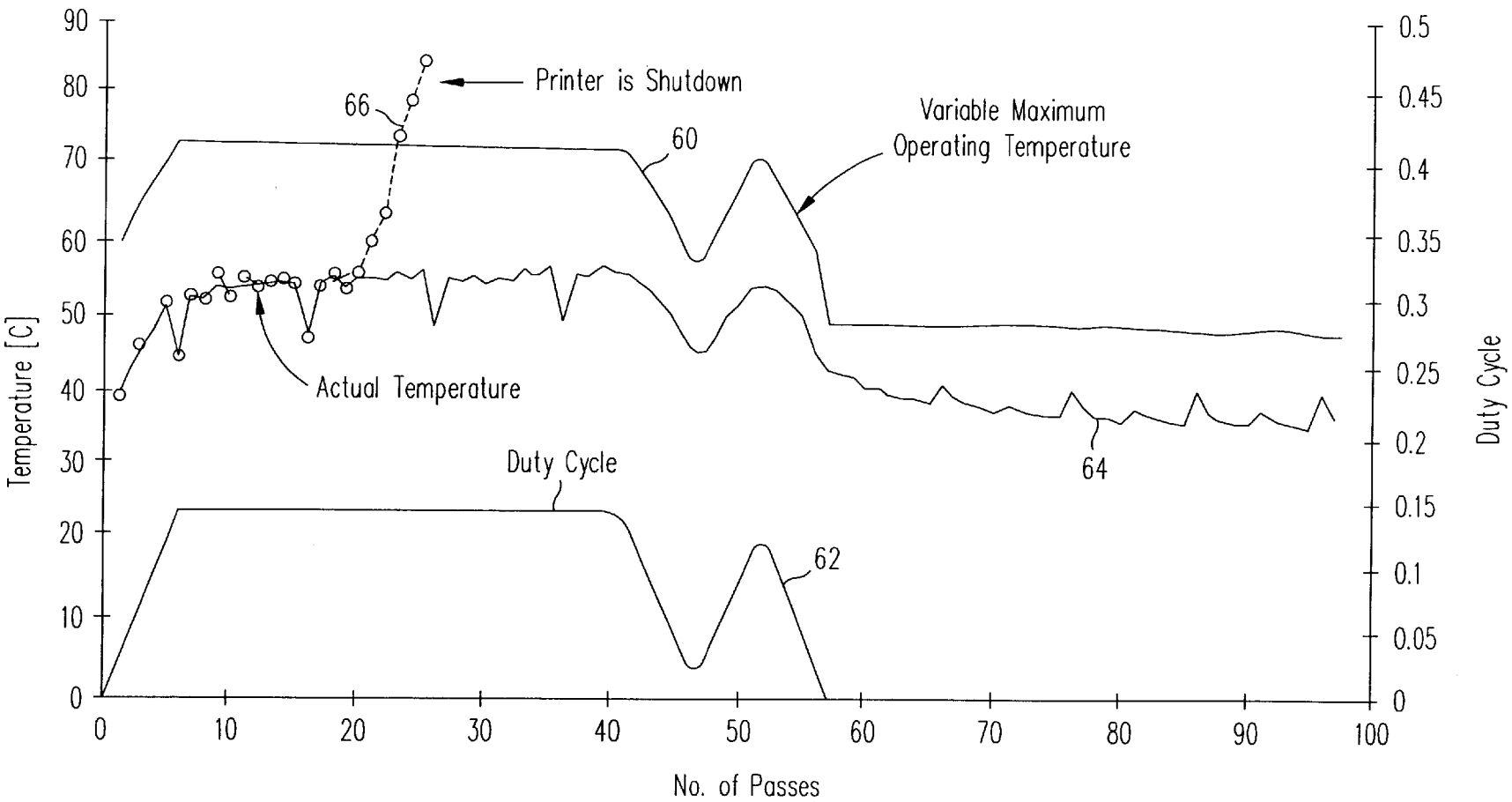
FIG. 3 is a graph illustrating a maximum operating temperature defined as a function of duty cycle, according to an embodiment of the present invention.

Thus, because the thermal characteristics of a printhead are related to the duty cycle, the maximum operating temperature for a printhead may be characterized or defined as a function of duty cycle. For example, in one embodiment of the present invention, as illustrated by the graph shown in FIG. 3, the maximum operating temperature for a printhead (indicated by line 60) varies directly with the current duty cycle for the printer (indicated by line 62). If at any point the actual measured printhead temperature (indicated by line 64) exceeds the maximum operating temperature, such as at point 66, the printer will be shut down, thereby preventing the printhead from overheating. The embodiment illustrated and described with reference to FIG. 3 is suitable for printing conditions/characteristics which are slowly changing or in steady state.

When changes to printing conditions/characteristics occur rapidly, however, other embodiments of the present invention may be utilized. These embodiments, illustrated by the graph shown in FIG. 4, recognize that the actual temperature of a printhead (indicated by line 68) does not always change as rapidly as the duty cycle (indicated by line 70). This phenomenon, known as thermal lag, is attributable to the presence of residual heat within a printer and the natural thermal inertia of every system. With thermal lag, a variable maximum operating temperature which follows the duty cycle too closely will shut down the printer in many cases when it should not be shut down. The embodiments shown in FIG. 4 address the problems associated with thermal lag.

According to a first approach (indicated by line 72), the margin between the variable maximum operating temperature and the duty cycle may be increased, thus resulting in an overall shift of the variable maximum operating temperature to a higher level. According to a second approach (indicated by line 74), a lag factor is introduced between the duty cycle and the variable maximum operating temperature. That is, changes in the maximum operating temperature will be made only after the passing of a predetermined interval from the detection of changes in duty cycle. With both of these approaches, the likelihood of thermal lag causing an undesirable shutdown is decreased.

Figure 4:
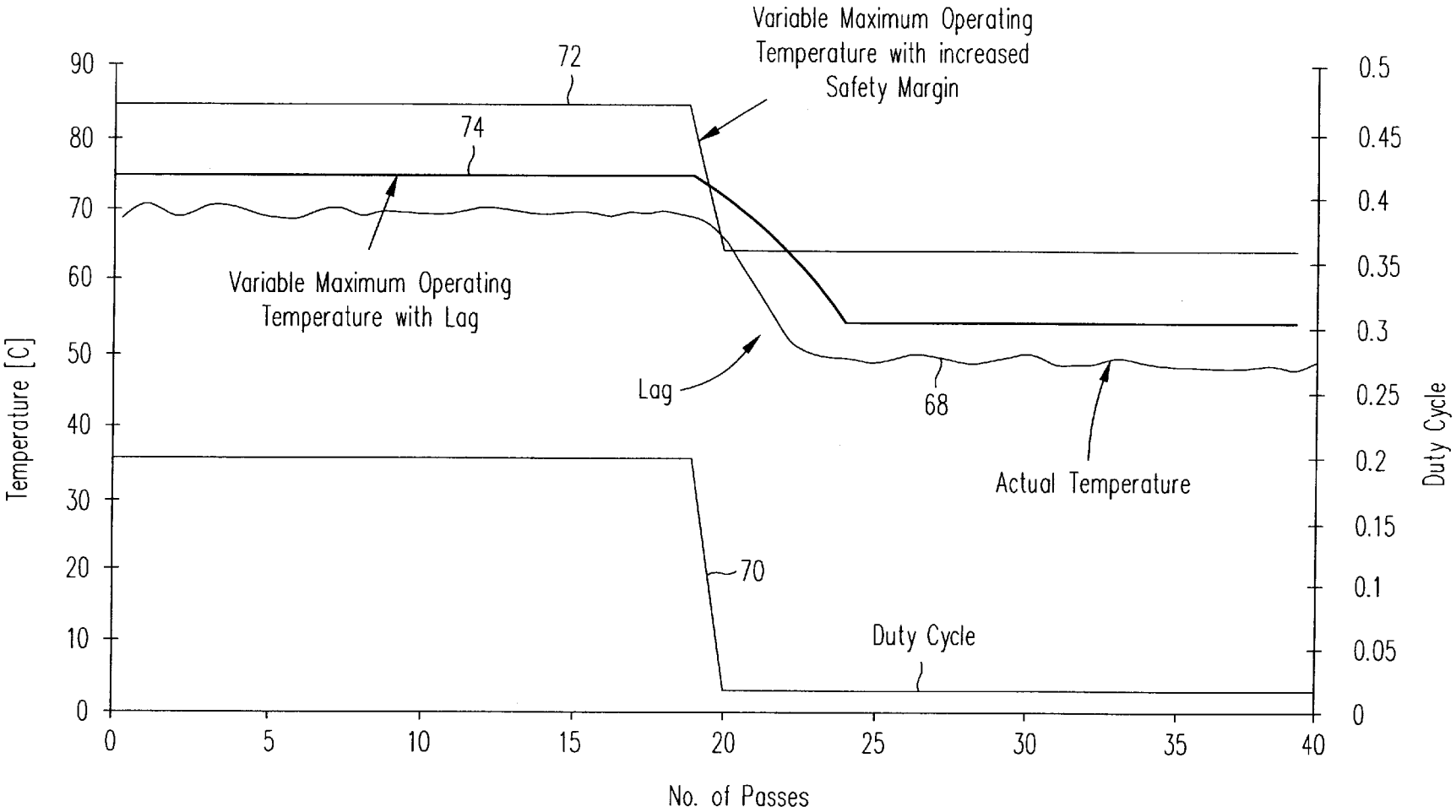
FIG. 4 is a graph illustrating a maximum operating temperature defined as a function of duty cycle, according to other embodiments of the present invention.

Although various embodiments have been illustrated and discussed with reference to FIGS. 3 and 4, it should be understood that the present invention is not so limited. Thus, for example, a maximum operating temperature for a printhead may be varied according to predicted, future printing conditions or characteristics. This can be accomplished by defining or characterizing the maximum operating temperature as a function of the information held in a buffer memory of the printer.

Figure 5:
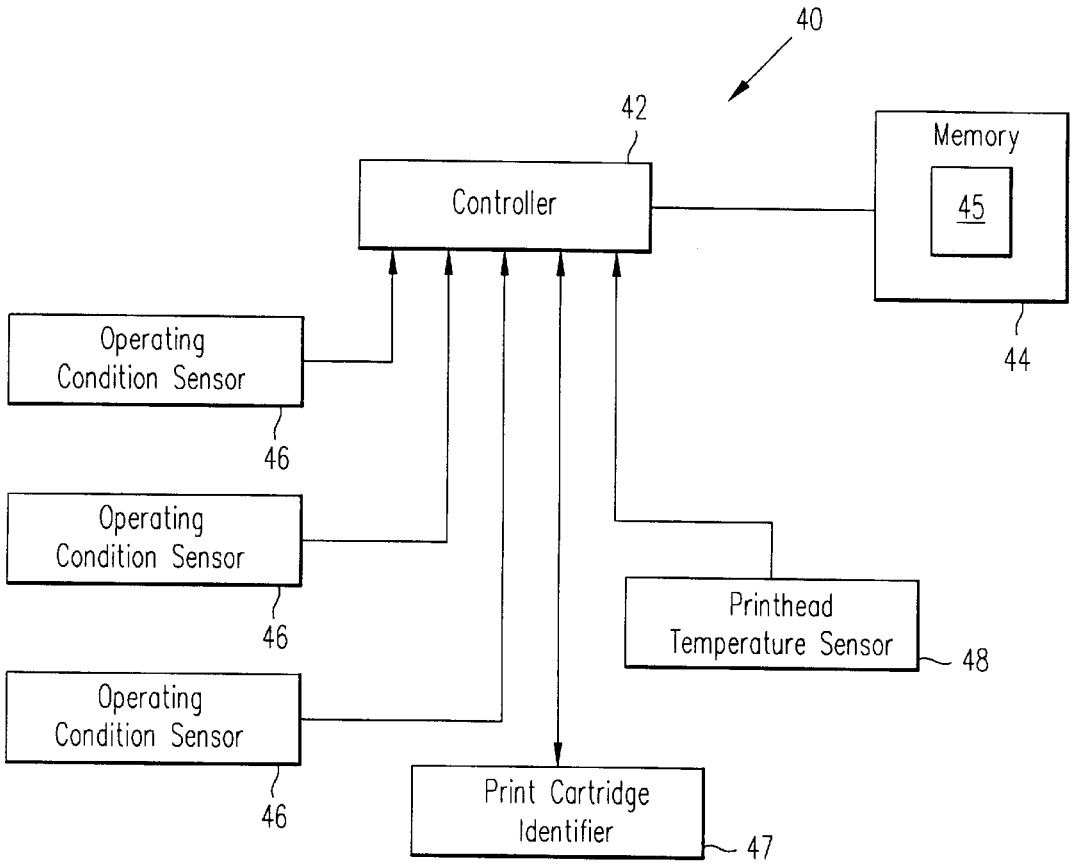
FIG. 5 is a schematic diagram of a system for varying the maximum operating temperature at which a printer is shut down.

FIG. 5 is a schematic diagram of a system 40 for varying the maximum operating temperature for a printhead, in accordance with the present invention. System 40 may be incorporated into an ink jet printer, such as that shown and described with reference to FIG. 1. Referring to FIG. 5, system 40 includes a controller 42 having an associated memory 44. In general, controller 42 functions to control the operation of a printer, for example, by receiving, initiating, issuing, routing, or forwarding different commands, signals, and messages to and from various parts of the printer. Controller 42 is also capable of performing various calculations The functionality of controller 42 may be performed by any suitable processor, such as a commercially available microprocessor or one that is resident on an Application Specific Integrated Circuit (ASIC).

Memory 44 is coupled to controller 42 and functions to receive, store, and forward various information 45, such as software code, logic, and data, related to and/or supporting the operation of the printer. In particular, information 45 may comprise information relating to a variable maximum operating temperature for the printhead of any print cartridge which may be used with the printer; as described herein, this maximum operating temperature may be varied according to the actual operating conditions and/or characteristics of the printer. Thus, the functions of maximum operating temperature to duty cycle shown and described with reference to FIGS. 3 and 4 may be included within information 45. Memory 44, which may comprise a relational database, can reside in any suitable storage medium, such as random access memory (RAM), read-only memory (ROM), disk, tape, or other volatile and/or non-volatile data storage system. It should be understood that memory 44 may also comprise memory internal to, or resident within, controller 42.

One more operating condition sensors 46 are also coupled to controller 42. Each operating condition sensor 46 functions to detect a particular operating condition within a printer. These operating conditions may include the location of a carriage along a slide rod, the print mode (e.g., fast or slow) for the printer, the number of passes or scans that should be made in a particular increment of time, the density of a print area (i.e., how much ink is to be deposited onto a particular area of printing), etc. In order to detect these operation conditions, sensors 46 may be implemented from one or a combination of various devices including, but not limited to, optical reflectors, photodetectors, buffers, and memory. Information or signals relating to the operating conditions detected by sensors 46 can be input, forwarded, or relayed to controller 42. Using such information or signals, controller 42 may calculate one or more operating characteristics, such as the velocity at which a carriage containing print cartridges moves and the duty cycle for the printer.

A print cartridge identifier 47 is coupled to controller 42 and functions to identify the type of each print cartridge actually incorporated into the printer. To accomplish this, print cartridge identifier 47 may include appropriate sensors, interfaces, circuits, contacts, switches, and the like for mechanical or electronic identification. Alternatively, information regarding the type of each print cartridge can be entered by a user via a suitable interface (e.g., keypad).

Figure 6:
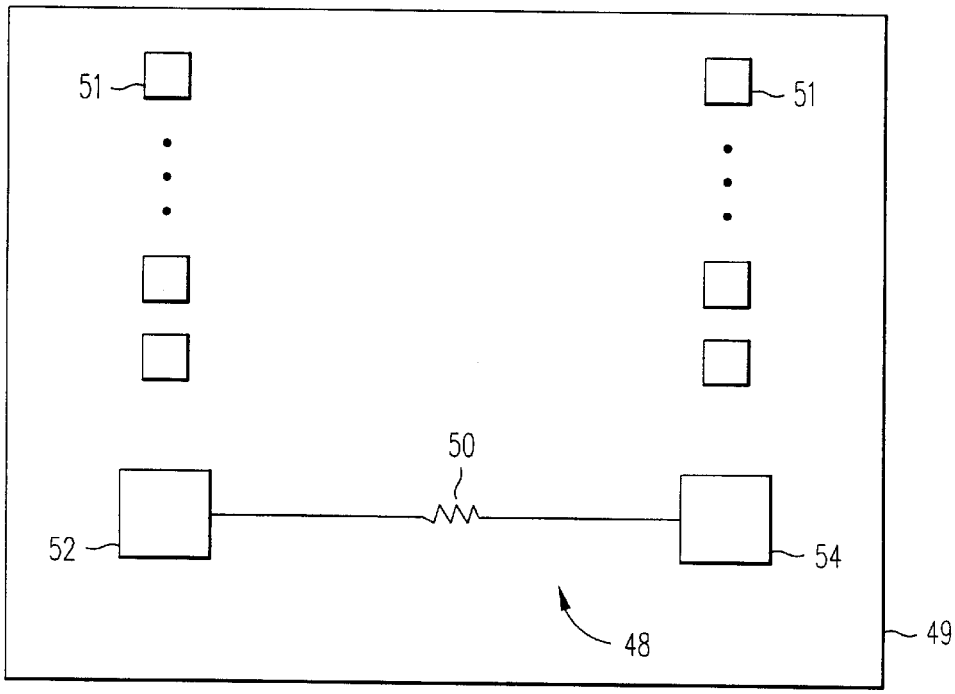
FIG. 6 illustrates an exemplary printhead temperature sensor.

A printhead temperature sensor 48, coupled to controller 42, functions to detect the temperature of a printhead in the printer. In one embodiment, a separate printhead temperature sensor 48 may be provided for each printhead currently incorporated into the printer. Printhead temperature sensor 48 may be implemented using a thermal sense resistor (TSR) formed on silicon die 49 containing heater resistors 51, as illustrated in FIG. 6. With reference to FIG. 6, printhead temperature sensor 48 may comprise a thermal sense resistor 50 connected between a first contact pad 52 and a second contact pad 54. Each of first and second contact pads 52 and 54 may be a contact pad disposed on a front surface of a flexible polymer circuit (see FIG. 2). The resistance value of thermal sense resistor 50 varies according to the temperature of a printhead. Thus, the printhead temperature may be calculated or derived by applying a known voltage drop across contact pads 52, 54 and measuring the resultant current flowing through thermal sense resistor 50. In another embodiment, a voltage drop across a PN junction is used to determine temperature. Other types of sensors may also be used.

Referring again to FIG. 5, in an exemplary operation of system 40, memory 44 may be loaded with information 45. This includes information relating to a variable maximum operating temperature for the printhead of any print cartridge which may be used with the printer. Print cartridge identifier 47 identifies the type of each print cartridge actually incorporated into the printer. Afterwards, when the printer is called to execute a print job, operating condition sensors 46 and printhead temperature sensor 48 detect various operating conditions (e.g., carriage location, the number of passes or scans that should be made in a particular increment of time, print area density, etc.) and the printhead temperature of the printer, respectively. Information regarding the detected operating conditions and temperature is relayed or input to controller 42, which may then calculate or derive values for one or more operating characteristics, such as carriage velocity and duty cycle.

Based upon the actual operating conditions and/or characteristics (detected and/or calculated), controller 42 may determine a maximum operating temperature for the printhead using information 45 stored in memory 44. Controller 42 then compares the actual temperature of the printhead against the determined maximum operating temperature for the particular operating conditions/characteristics. If the actual temperature of the printhead is greater than the determined maximum operating temperature, controller 42 shuts down the printer and may also initiate one or more suitable recovery routines. Shut down of the printer prevents the printhead from overheating, thereby extending the useful life of the printhead and reducing the waste of paper.

Furthermore, the present invention contemplates that system 40 may operate robustly to incorporate information that is "learned" over time. Additional details regarding the robust nature, and also the initialization and operation of system 40, are described below with reference to FIGS. 7–9.

Figure 7:
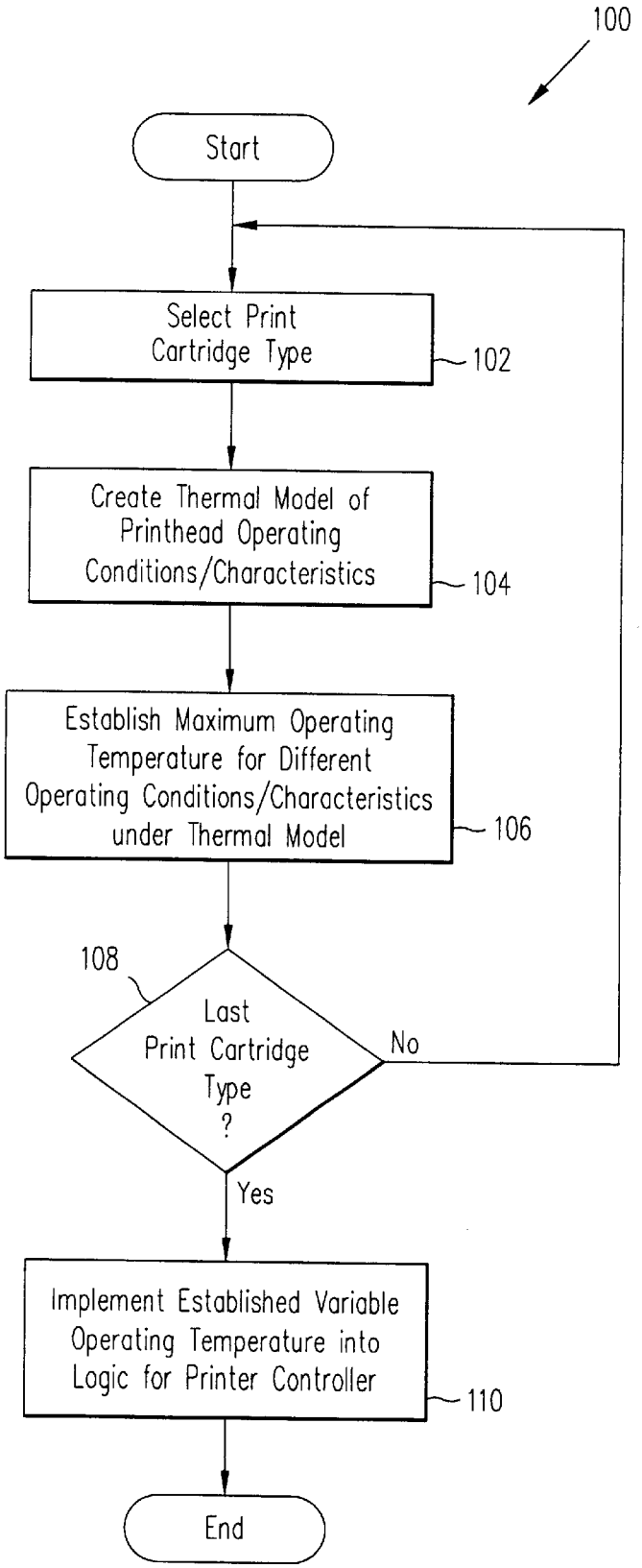
FIG. 7 is a flow chart of a method for initializing or setting a variable maximum operating temperature for a printhead.

FIG. 7 is a flowchart of a method 100 for initializing or setting a variable maximum operating temperature for a printhead, in accordance with one embodiment of the present invention. Method 100, which can be used to initialize system 40 shown in FIG. 5, determines or creates a variable maximum operating temperature for each of a number of different print cartridge types. Each type of print cartridge may have its own, distinct characteristics such that it is affected by a particular set of operating conditions/characteristics in a way that is different from other print cartridge types.

Method 100 begins at step 102 where a print cartridge type is selected. At step 104, a thermal model for the selected print cartridge type is generated or created, for example, by empirical analysis, for various operating conditions/characteristics. These operating conditions/characteristics may include any one, or a combination, of print area density, carriage location, carriage velocity, number of passes, duty cycle, or any other suitable operating condition/characteristic. The thermal model embodies the relationship between the operating conditions/characteristics and the temperature of the printhead. In particular, the thermal model specifies the temperatures at which the printhead will begin to overheat for various operation conditions/characteristics.

At step 106, a variable maximum operating temperature is established for the selected print cartridge type based upon the different operating conditions/characteristics of the thermal model. In other words, the method provides a separate maximum operating temperature for each particular set or combination of operating conditions/characteristics. Thus, the maximum operating temperature for the print cartridge type is not a single, fixed value.

At step 108, method 100 determines whether the current print cartridge type is the last for which a variable maximum operating temperature is to be established. If the current print cartridge type is not the last, method 100 returns to step 102 where another print cartridge type is selected.

Steps 102 through 108 are repeated until a variable maximum operating temperature for all the print cartridge types has been created. When there are no other print cartridge types left, method 100 proceeds to step 100 where the variable maximum operating temperature for each print cartridge type, and at least a portion of its thermal model, is implemented into the logic of controller 42 (FIG. 5). Method 100 then ends.

Figure 8:
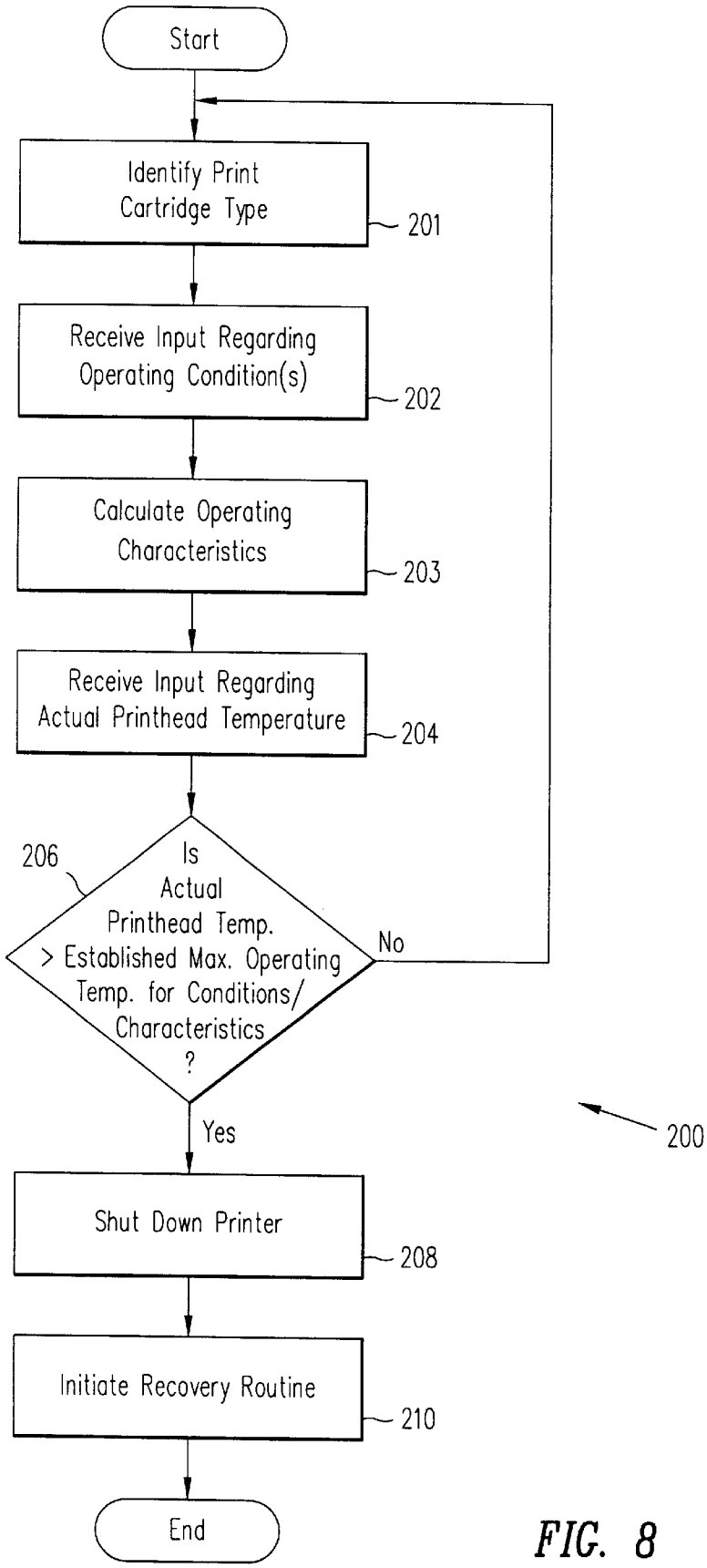
FIG. 8 is a flow chart of a method for operating a printer using a variable maximum operating temperature for a printhead.

FIG. 8 is a flowchart of a method 200 for operating a printer using the variable maximum printhead operating temperature technique described herein. In one embodiment, method 200 corresponds to the operation of system 40 (FIG. 5).

Method 200 begins at step 201 where print cartridge identifier 47 identifies the type of each print cartridge actually incorporated into the printer. At step 202, controller 42 receives input regarding various operating conditions (e.g., print area density, carriage location, number of passes, etc.) throughout the printer. This input is collected and forwarded by one or more operating condition sensors 46. Using this input, controller 42 may calculate values for operating characteristics (e.g., carriage velocity and duty cycle) at step 203. Based upon the values (either detected or calculated) for the actual operating conditions and characteristics, controller 42 may determine the established maximum operating temperature for the printhead under those conditions/characteristics. This can be done, for example, by referring to the thermal model previously implemented into the controller's logic. At step 204, controller 42 receives input regarding the actual printhead temperature from printhead temperature sensor 48.

Next, at step 206, controller 42 determines whether the actual printhead temperature is greater than the established maximum operating temperature for the present operating conditions/characteristics. If not, method 200 returns to step 202 where controller 42 receives more input regarding operating conditions throughout the printer. On the other hand, if controller 42 determines that the actual printhead temperature is greater than the established maximum operating temperature for the present operating conditions/characteristics, then controller 42 shuts down the printer at step 208. This prevents the further waste of paper and also extends the life of the printhead.

At step 210, controller 42 initiates one or more suitable recovery routines for the printer. Method 200 then ends.

Figure 9:
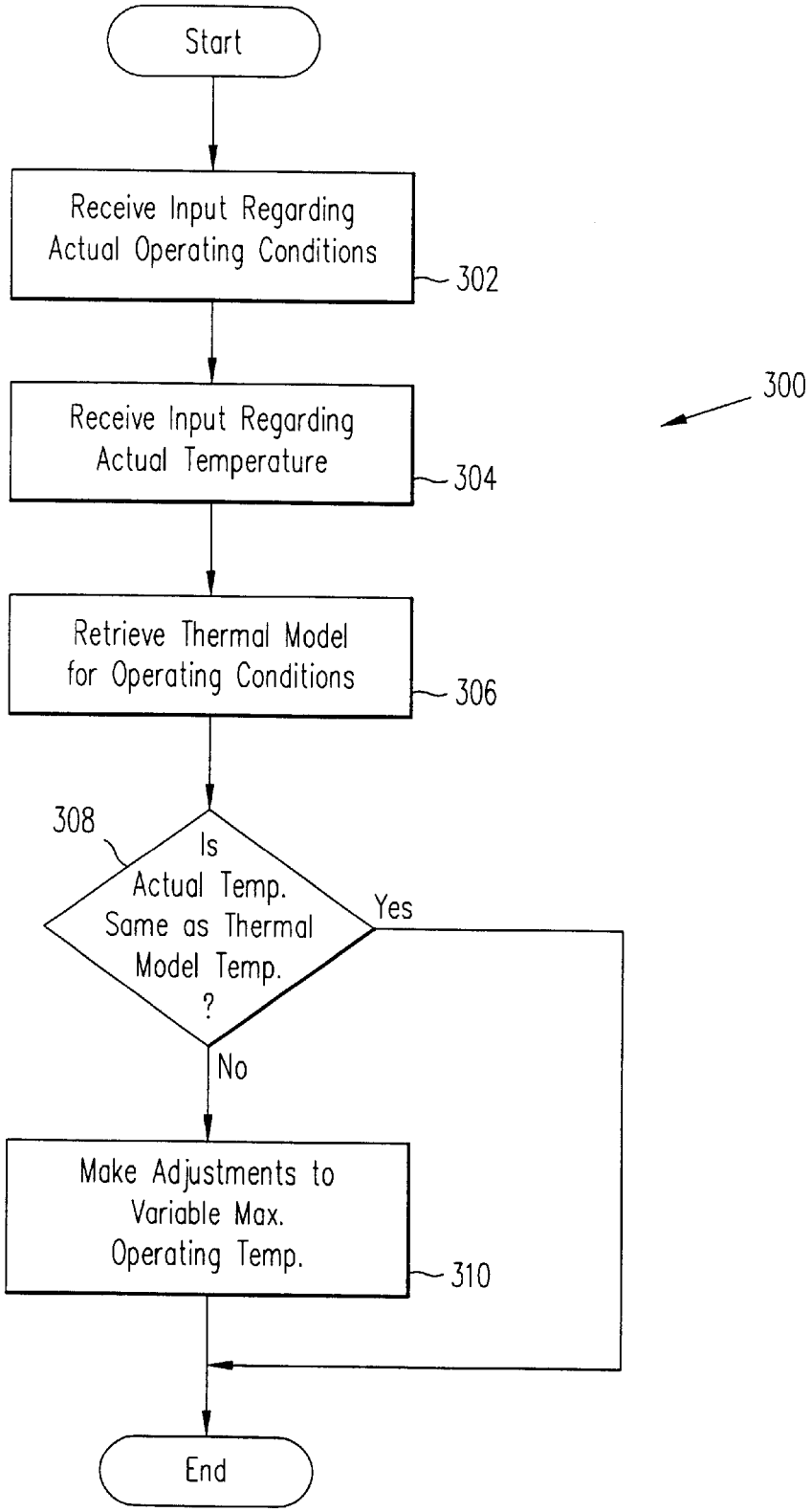
FIG. 9 is a flow chart of a method for robustly varying the maximum operating temperature of a printhead.

FIG. 9 is a flowchart of a method 300 for robustly varying the maximum operating temperature of a printhead according to the operation of a specific print cartridge. Method 300 may be performed during an initialization period that begins when a new print cartridge is inserted into a printer. Here, the variable maximum operating temperature for a particular print cartridge type, as established by method 100 described with reference to FIG. 7, may be used as an initial default for each print cartridge of that type. However, the specific operating characteristics of a particular cartridge may be "learned," and the variable maximum operating temperature adjusted accordingly, under method 300. Method 300 may also be performed at various times after initial insertion into the printer so that the variable maximum operating temperature is routinely adjusted to account for changes in the operating characteristics of the cartridge.

Method 300 begins at step 302 where input regarding the actual operating conditions of a particular print cartridge is received by controller 42. At step 304, controller 42 receives input regarding the actual temperature of a printhead for the print cartridge under those operating conditions.

At step 306, controller 42 retrieves a thermal model for the particular cartridge type. This thermal model specifies a value (which can be empirically derived) for an average printhead temperature corresponding to a cartridge of that type and under the present operating conditions. This thermal model may also specify a default variable maximum operating temperature for the same operating conditions and type of cartridge.

At step 308, controller 42 determines whether the actual temperature of the particular cartridge is the same as the temperature specified in the thermal model for that cartridge type. If not, then at step 310 controller 42 makes adjustments to the variable maximum operating temperature to account for the characteristics of the particular cartridge. For example, if controller 42 determines that the actual temperature for the particular cartridge is higher than the temperature specified in the thermal model, the maximum operating temperature under the given conditions would be adjusted upward to a higher value. Alternatively, if at step 308 it is determined that the actual temperature is the same as that specified in the thermal model, then method 300 skips step 310. Method 300 ends.

Although the present invention and its advantages have been described in detail, it should be understood that various changes, substitutions, and alterations can be made therein without departing from the spirit and scope of the invention as defined by the appended claims.

What is claimed is:

1. A method comprising:

relating an operating condition of a printer to a variable maximum operating temperature for a printhead incorporated into the printer, the variable maximum operating temperature varying according to the operating condition;

detecting an actual operating condition while the printer is operated;

detecting an actual temperature for the printhead while the printer is operated; and shutting down the printer if the actual temperature exceeds the variable maximum operating temperature for the actual operating condition.

2. The method of claim 1, wherein the actual operating condition is a duty cycle for the printer.

3. The method of claim 1, further comprising initiating a recovery routine.

4. The method of claim 1, further comprising adjusting the variable maximum operating temperature to account for particular operating characteristics of the printhead.

5. The method of claim 1, further comprising identifying the type of each print cartridge incorporated into the printer.

6. A printer comprising:

a print cartridge having a printhead; and a system for varying a maximum operating temperature of the printhead, wherein the system comprises:

an operating condition sensor detecting an operating condition within the printer;

a printhead temperature sensor detecting a temperature of the printhead; and a controller coupled to the operating condition sensor and the printhead temperature sensor, the controller comparing the temperature of the printhead against a variable maximum operating temperature which varies according to the operating condition.

7. The printer of claim 6, wherein the system shuts down the printer if the detected temperature of the printhead is greater than the variable maximum operating temperature corresponding to the detected operating condition.

8. The printer of claim 6, wherein the controller calculates operating characteristics of the printer using the detected operating condition.

9. The printer of claim 8, wherein the operating characteristics include a duty cycle for the printer.

10. The printer of claim 8, wherein the detected operating condition is an operating condition selected from the group consisting of print area density, carriage velocity, and number of carriage passes.

11. The printer of claim 6, further comprising a print cartridge identifier coupled to the controller, the print cartridge identifier identifying the type of each print cartridge incorporated into the printer.

* * * * *

UNITED STATES PATENT AND TRADEMARK OFFICE

CERTIFICATE OF CORRECTION

PATENT NO. : 6,276,777 B1 
DATED : August 21, 2001
INVENTOR(S) : Stefano Schiaffino, Sebastia Castelltort and H. Donovan It is certified that error appears in the above-identified patent and that said Letters Patent is hereby corrected as shown below:

Column 2,
Line 7, please delete “a” after “or” and before “in”;

Column 8,
Line 50, please delete “100” after “step” and insert -- 110 --;

Column 10,
Line 55, please delete “detected”; and
Line 56, please delete “the” and insert -- a --.

Signed and Sealed this

Fourteenth Day of January, 2003

JAMES E. ROGAN
*Director of the United States Patent and Trademark Office*